United States Patent [19]

Carter

[11] 4,061,348

[45] Dec. 6, 1977

[54] ROLLER SKATES

[76] Inventor: Lewis H. Carter, 969 Menlo Ave., Menlo Park, Calif. 94025

[21] Appl. No.: 752,412

[22] Filed: Dec. 20, 1976

[51] Int. Cl.[2] ..... A63C 17/14

[52] U.S. Cl. ..... 280/11.21; 188/82.9; 280/11.14

[58] Field of Search ..... 280/11.21, 11.2, 11.19, 280/11.1 R, 11.14; 188/82.9, 82.1, 17, 18 A

[56] References Cited

U.S. PATENT DOCUMENTS

| | | | |
|---|---|---|---|
| 906,281 | 12/1908 | Plimpton | 280/11.2 |
| 920,848 | 5/1909 | Eubank, Jr. | 280/11.2 |
| 1,628,559 | 5/1927 | Showers | 280/11.2 |
| 2,173,716 | 9/1939 | Gurleay | 280/11.2 |
| 2,725,238 | 11/1955 | Day | 280/11.2 |
| 3,790,187 | 2/1974 | Radu | 280/11.21 |
| 3,871,672 | 3/1975 | Bardy | 280/11.21 |
| 3,945,655 | 3/1976 | Banks | 280/11.2 |

FOREIGN PATENT DOCUMENTS

| | | | |
|---|---|---|---|
| 4,344 of | 1908 | United Kingdom | 280/11.21 |
| 15,885 of | 1885 | United Kingdom | 188/82.9 |

*Primary Examiner*—Joseph F. Peters, Jr.
*Assistant Examiner*—David M. Mitchell
*Attorney, Agent, or Firm*—Gregg, Hendricson, Caplan & Rosso

[57] ABSTRACT

A pair of foot-size metal plates, one atop the other, secured together by a compressible material, the upper plate having a hinged heel portion which can be moved downwardly by heel pressure. The upper plate has straps for attachment to a foot or shoe, and the lower plate has front and rear axles which carry a first and second pair of wheels. The first pair of wheels has disc brakes actuated only upon backward motion of the skate, and the second pair of wheels has disc brakes actuated by levers connected to the hinged heel portion of the upper plate, such that the skate can be stopped by heel pressure of the user. Spring means secured between the hinged heel portion of the upper plate and the rear portion of the lower plate urges the hinged heel portion upwardly to allow forward motion.

9 Claims, 7 Drawing Figures

ROLLER SKATES

BACKGROUND OF THE INVENTION

This invention relates to roller skates, and more particularly to an improved skate having superior braking and maneuvering features.

A variety of roller skates have been available for recreational purposes only, such as the roller skate of U.S. Pat. No. 1,790,423, for producing pyrotechnic effects, and the skate of U.S. Pat. No. 1,551,571, adapted for rapid forward skating on sidewalks. See also U.S. Pat. Nos. 1,016,447; 1,026,712; 341,999 and 829,900. Many of such skates have braking devices, usually affixed to the rear wheels, for stopping of the skates by movements of the wearer's foot. None, however, has proven satisfactory for widespread use as a means of enabling a pedestrian to cover long distances on foot with a minimum of effort.

More recently, improved roller skates have been developed for other than purely recreational purposes. For example, U.S. Pat. No. 3,871,672 describes a complex roller skate utilizable for safe and convenient skating and walking, and for purposes and utilities other than mere amusement. Similarly, U.S. Pat. No. 3,790,187 describes a walking system for paraplegic patients. But none of such modern skates has provided a simple, inexpensive and practical skate capable of being used by a novice skater over considerable distances.

SUMMARY OF THE INVENTION

In accordance with this invention, a roller skate having improved maneuvering and braking characteristics is provided comprising an upper foot-sized plate having a front portion hingedly connected to a heel portion, a lower plate continuous with the upper plate, a compressible material such as foam rubber disposed between the front portion of the upper plate and the corresponding portion of the lower plate and bonded to the upper and lower plates, and a front and rear pair of wheels disposed on axles secured to the lower plates, with front disc brakes secured to each of the front wheels for preventing backward motion of the front wheels, and rear disc brakes disposed on the rear wheels and actuated by downward movement of the hinged heel portion of the upper plate in response to the heel pressure of the user's foot. Accordingly, the front brakes will permit the wearer to walk up an inclined surface, such as a hill, and the rear brakes will permit rapid stopping by easily applied heel pressure.

It is a primary object of this invention to provide a roller skate having the front wheels rotatable only in a forward direction, with the rear wheels adapted for braking by means of heel pressure.

It is another object of this invention to provide a roller skate which can be used by a novice for walking considerable distances without the need for extensive training in the use of the skates.

It is another object of this invention to provide a roller skate usable for going up or down hills, ramps, or similarly inclined surfaces.

It is yet a further object of this invention to provide a roller skate having superior maneuvering and braking characteristics.

It is a still further object of this invention to provide an inexpensive and yet highly efficient skate for allowing walking over considerable distances with a minimum of effort.

It is a further object of this invention to provide a roller skate having a built-in cushion feature to absorb shock from rough surfaces.

BRIEF DESCRIPTION OF THE DRAWINGS

The above and other objects, features and advantages of the present invention will become more readily apparent from the following description, reference being made to the accompanying drawing in which.

DESCRIPTION OF PREFERRED EMBODIMENT

Figure 1:
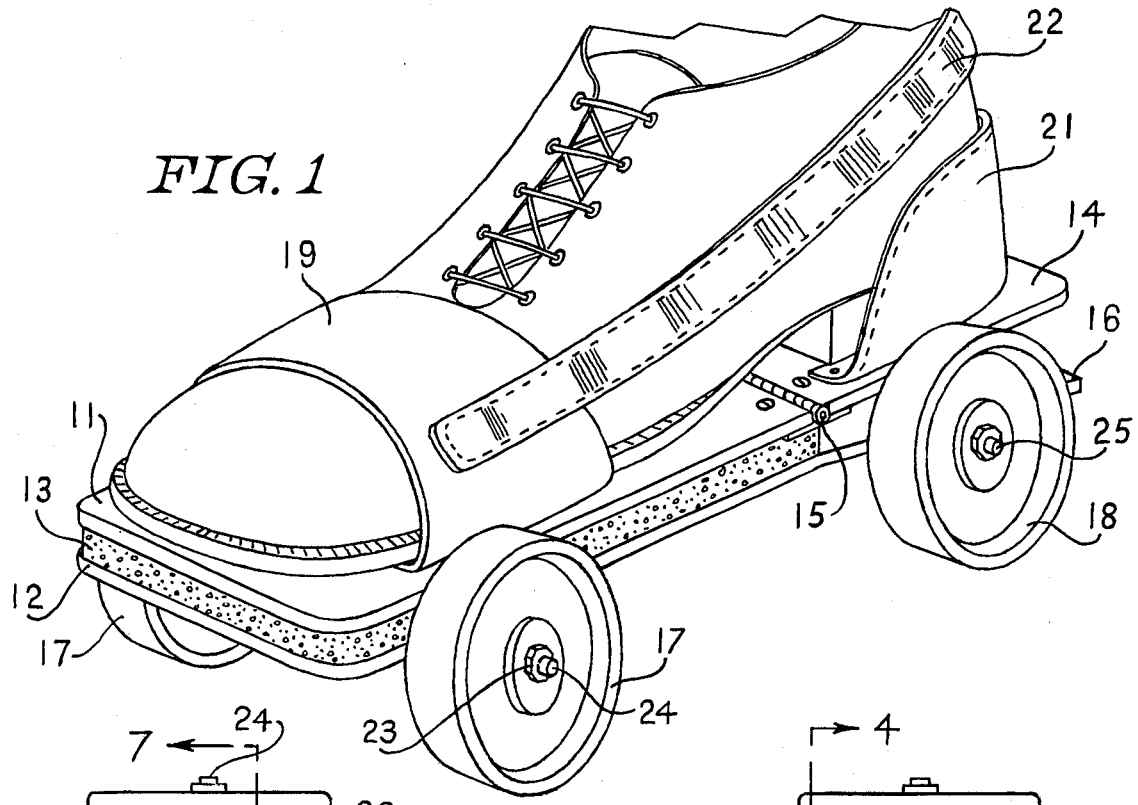
FIG. 1 is a perspective view showing the skate of this invention in operation.

Referring to FIG. 1, the improved skate of this invention comprises an upper plate 11 bonded to a lower plate 12 by a compressible material 13, the upper plate having a rear heel portion 14 connected by hinge 15 to the upper plate 11. The hinge is located a short distance ahead of the front edge of the user's heel. Similarly, the lower plate 12 has a rear portion 16 continuous with the heel portion 14 of the upper plate 11. The compressible material 13 fills the space between the upper and lower plates, from the hinge connection to the front of the plates. A pair of front wheels 17 and a pair of rear wheels 18 are rotatably secured to the lower plate 12, the front wheels being rotatable only in a forward direction and the rear wheels being subject to a braking action controlled by the pressure of the user's heel on the rear portion 14, as will be described.

A toe strap 19, a stirrup 21, and a heel strap 22 are secured to the upper surface of the plate 11 for firmly holding the user's shoe in proper position atop the upper plate 11, with the heel of the user resting at the center of the heel portion 14. The toe strap, stirrup, and heel strap may be of leather, plastic, or any other strong and comfortable material. As well, various means of strapping the shoe of the wearer onto the upper plate may be provided, as long as the heel is properly disposed on the heel portion 14. Although a shoe is shown, it is understood that the user may use the skate barefoot.

Figure 2:
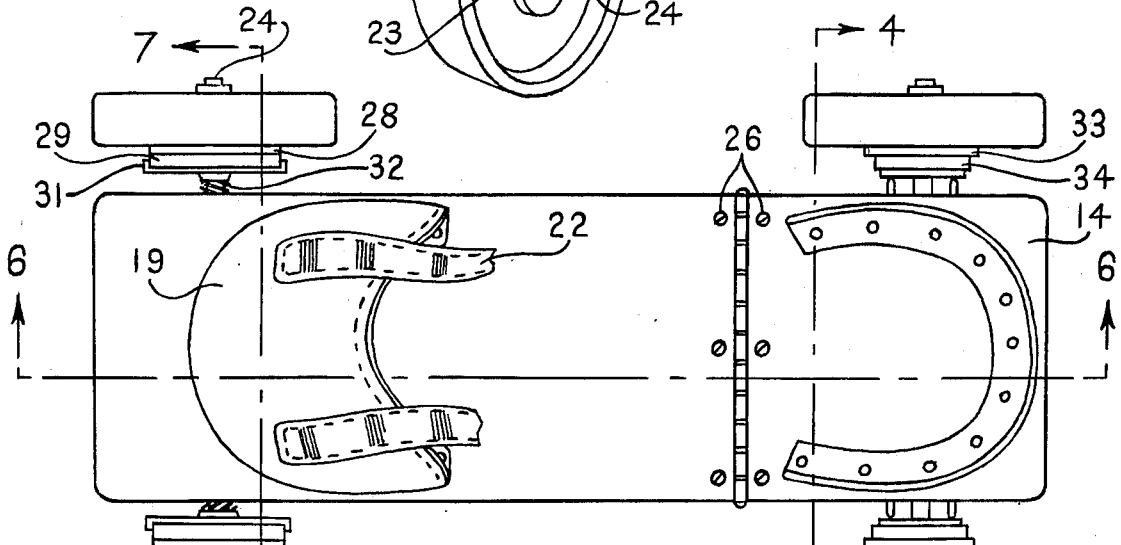
FIG. 2 is a top plan view of the skate of this invention.
Figure 3:
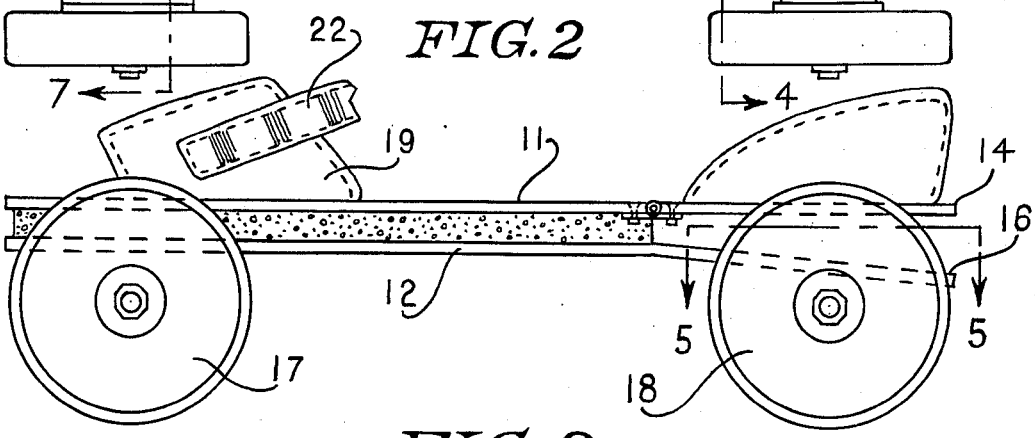
FIG. 3 is a side elevational view of the skate, partially in section.

The front and rear wheels 17, 18 may be conventional roller skate wheels of durable steel or the like, and are held by nuts 23 on front and rear axles 24, 25. The upper and lower plates 11, 12 may be steel or any other material capable of supporting the user's weight. Hinge 15 is secured to plate 11 and heel portion 14 by three pairs of screws 26, as shown in FIG. 2. Rear portion 16 of lower plate 12 is downwardly inclined from a point where the compressible material 13 ends, as shown in FIG. 3.

The unique braking and handling characteristics of the roller skate of this invention result from a combination of front and rear wheel braking discs. As shown in FIG. 2, and as discussed in considerably more detail in subsequent figures, each front wheel has braking discs 28, 29, with disc 29 being secured to nut 31 disposed on the front axle 24. Spiral spring 32 holds the braking discs in contact and allows slight separation of the discs when the wheels rotate in the forward direction. Upon rotation in a rearward direction, however, pressure of the spiral spring will cause the nut to move outwardly such that the braking discs 28, 29 will be forced into braking relationship, thereby preventing rearward motion of the skates. At the rear wheels, discs 33, 34 are brought into braking relationship by downward pressure on heeled portion 14 of the upper plate 11.

Figure 4:
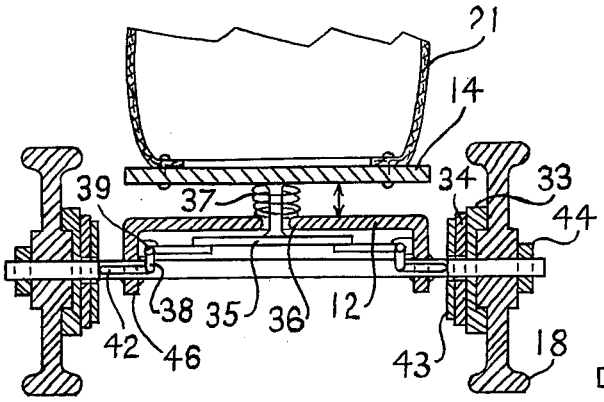
FIG. 4 is a sectional view taken along line 4—4 of FIG. 2.
Figure 5:
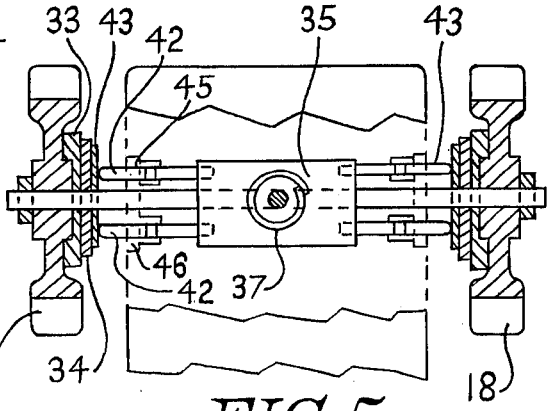
FIG. 5 is a sectional view taken along 5—5 of FIG. 3.

Referring to FIGS. 4 and 5, illustrating in detail the rear wheel braking action, heel portion 14 of upper plate 11 has a plunger 35 secured to its undersurface with the shaft of the plunger extending through an opening 36 in the lower plate 12. Spring 37, calibrated according to the weight of the user, is disposed around the shaft of the plunger 35 between the heel portion 14 and the rear portion 16 of lower plate 12, such that when weight is evenly distributed over the upper plate upon the balls as well as the heels of the feet, the heel portion 14 will be maintained in a substantially horizontal position with the braking discs 33, 34 in non-braking relationship. When the user shifts his weight onto his heel to counteract the force of spring 37 the plunger 35 will cause angle piece 38 to pivot around point 39. The vertical member of angle piece 38 contacts pins 42 secured to plate 43, to which is secured braking disc 34, urging such disc against disc 33, secured to hub 44 of the rear wheel 18. As shown in FIG. 5, a pair of pins 42 are secured to each plate 43, the pins sliding in openings 45 of brackets 46 depending from the rear portion 16 of lower plate 12. Accordingly, the pins 42 can only move inwardly and outwardly along their axes, and the plate 43 is similarly restricted to motion toward or away from the braking disc 33. That is, braking disc 34 secured to plate 43 will be prevented from rotating by the pins 42.

Figure 6:
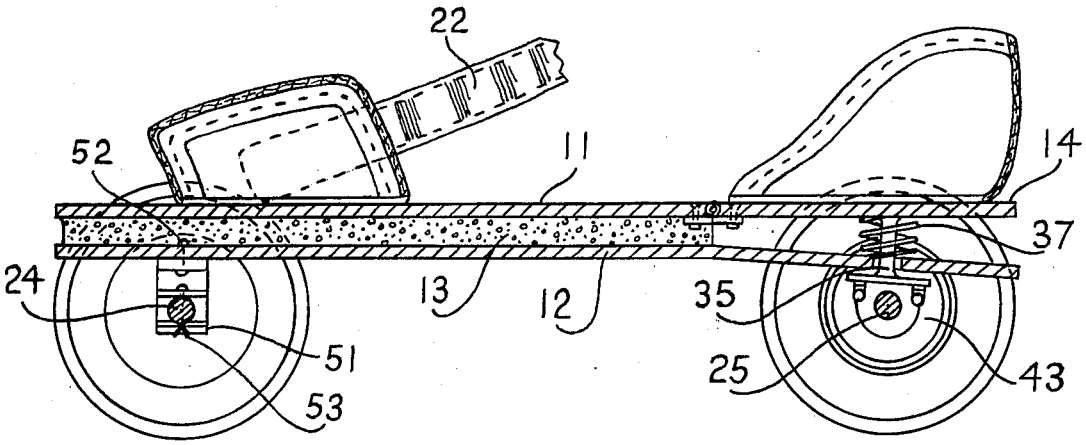
FIG. 6 is a sectional view taken along line 6—6 of FIG. 2.

Referring to FIG. 6, the front axle 24 is disposed on bracket 51 secured to the underside of lower plate 12 by bolt 52, the front axle being under the balls of the user's foot. The axle 24 is secured to the bracket 51 by cotter pins 53. The rear axle 25 is disposed on brackets 46 as shown in FIG. 4 with the plate 43 being slidably disposed on axle 25 as discussed above, the rear axle being located under the heel of the user's foot. As shown in FIG. 6, the spring 37 holds the heel portion 14 of the upper plate 11 in a substantially horizontal position with the plunger 35 in non-engaging relationship with the angle piece 38 and pins 42, such that forward motion of the skates will be possible.

Figure 7:
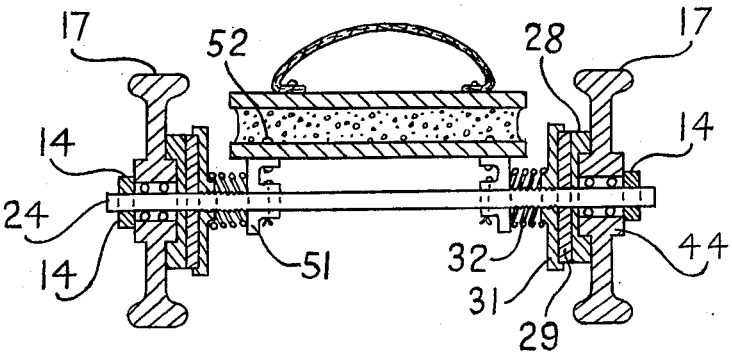
FIG. 7 is a sectional view taken along line 7—7 of FIG. 2.

As shown in FIG. 7, the front wheels 17, as well as the rear, are conventional roller skate, ball bearing wheels secured by nuts 14 to axle 24. However, each wheel hub 44 has a braking disc 28 secured to it adjacent to a braking disc 29 mounted on nut 31. The nut 31 is threaded in such a manner that when the wheel rotates in a forward direction the friction between the two braking discs 28, 29 will cause the nut to travel on the thread and recede from the wheel, allowing unimpeded forward motion of the skate. Spiral spring 32 urges the nut 31 in the opposite direction, such that the braking discs 28, 29 will contact one another when the wheel is at rest. Upon any attempted rearward rotation of the wheel, the spring pressure will result in seizure of the braking discs, such that rearward motion of the skate is prevented.

Preferably, the front braking discs have radial grooves arranged such that the portion between the grooves of one disc will fit into the grooves of its mate.

The combination of a disc-braking system for the front wheels to prevent rearward motion thereof, together with a heel-activated, disc-braking system for stopping the skate has been found to provide an extremely maneuverable and quick-stopping roller skate. When the user wishes to move in a forward direction, he rolls one skate in a forward direction while giving a shove with the other foot. This is accomplished as easily as if the user were walking, since the front wheels cannot revolve in a backward direction. Once in motion, the user brings the rear foot ahead of the other, shoving off with the other skate. In other words, the user can use a customary walking motion rather than a skating motion, except that at no time is the foot lifted from the supporting surface. Due to the forward motion feature of the front wheels and the excellent braking characteristics due to the heel-pressure, rear braking system, the user can use the skates of this invention for movement both up and down an inclined surface, such as a hill. On flat surfaces, considerable distance can be covered using a minimum of effort and without the need for extensive training on the skates. In order to decrease the speed or to stop, the user need only shift his weight such that the heel of one or both feet activates the rear braking discs. In a short time, such braking action becomes reflexive.

The improved roller skate of this invention can be used to advantage in numerous everyday situations. For example, a housewife could use the skates to replace the automobile for trips to the market, etc. A school child could use the skates to replace the bicycle. More importantly, a commuter could use the skates for traveling from home to the rapid transit station, to replace the automobile.

In addition to the superior maneuvering and braking characteristics of the roller skate of this invention, it is noted that the skate can be inexpensively manufactured using readily available materials. Maintenance of the skate, as well as replacement of parts, would also involve only a minimal expense. Additionally, the construction of the skates is simple enough that the skates could be purchased in pre-assembled form and put together by the user in a relatively short period of time.

The utilization of braking discs rather than a ratchet and pawl arrangement has further been found to be particularly advantageous in providing superior as well as trouble-free braking for both the front and rear wheels. That is, the ratchet and pawl systems used in previous roller skates have not provided a skate having the combined braking and maneuvering characteristics of the improved skate herein disclosed.

Although only one specific embodiment of the improved roller skate of this invention has been described, it is clear that modifications of the invention can be made by those skilled in the art, without departing from the spirit thereof, as set forth in the following claims.

What is claimed is:

1. A roller skate comprising an upper foot-size plate having a front portion and a heel portion, a hinge pivotally interconnecting said front and heel portions, and further having means for strapping a foot onto the upper plate, a lower plate continuous with the upper plate, a compressible material disposed between the front portion of the upper plate and the corresponding portion of the lower plate and bonded to the upper and lower plates to hold the plates secure one atop the other, a pair of front wheels disposed on an axle secured to the undersurface of the lower plate, a pair of rear wheels disposed on an axle secured to the undersurface of the lower plate, a first braking disc secured to the wheel hub of each front wheel, a second braking disc slidably mounted on the front axle adjacent to the first braking disc, means for urging the first and second braking discs into braking relationship when the wheel goes in a backward direction but allowing forward motion of the wheels, a first rear braking disc secured to the hub of each rear wheel, a second rear braking disc slidably mounted on the axle adjacent the first disc, and lever actuated by downward heel pressure on the heel portion of the upper plate for moving the rear braking discs together, and spring means for disengaging the rear braking discs to allow forward motion of the skate.

2. The improved skate of claim 1 wherein the hinge of the upper plate is located a short distance ahead of the front edge of the user's heel.

3. The improved skate of claim 1 wherein the front axle is located under the balls of the foot and the rear axle is located under the heel.

4. The improved skate of claim 1 wherein the front braking discs have radial grooves so arranged that the portion between the grooves on one disc will fit into the grooves of its mate.

5. The improved skate of claim 1 wherein the rear portion of the lower plate is inclined with respect to the front portion thereof.

6. The improved skate of claim 1 wherein the compressible material disposed between the plates is foam rubber.

7. The improved skate of claim 1 wherein the means for urging the first and second braking discs together when the wheel goes in a rearward direction comprises a nut carrying the movable braking disc and being movable on threads allowing travel of the nut away from the wheel only when the wheel rotates in a forward direction, and a spiral spring urging the nut in the opposite direction for bringing the braking disc together when the wheel rotates in a rearward direction.

8. The improved skate of claim 1 wherein the lever means for activating the rear disc brakes comprises a plunger member secured at its upper end to the underside of the heel portion of the upper plate and extending through an opening in the lower plate, the lower end of the plunger member contacting an angle piece secured to the lower plate adjacent each rear wheel, and wherein said spring means comprises a spring disposed around the shaft of the plunger member between the upper and lower plates for holding the heel portion in a substantially horizontal position with the braking discs in non-contacting relationship, and a pair of pins secured to a plate and being slidably disposed in transverse openings of a bracket depending from the lower plate, the pin-containing plates further having secured thereto said second rear braking disc, such that when heel pressure counteracts the force of the spring to move the plunger downwardly, the angle piece will be moved by the plunger against the pins to bring the braking discs together, thereby stopping the skate.

9. The improved skate of claim 8 wherein the spring has a stiffness which normally supports the evenly distributed weight of the user.

* * * * *